United States Patent [19]

Forster

[11] 4,283,962

[45] Aug. 18, 1981

[54] SPRING RETURN MECHANISM FOR AXIAL PISTON MACHINES

[75] Inventor: Franz H. Forster, Muhlbach, Fed. Rep. of Germany

[73] Assignee: Linde Aktiengesellschaft, Wiesbaden, Fed. Rep. of Germany

[21] Appl. No.: 899,814

[22] Filed: Apr. 25, 1978

[30] Foreign Application Priority Data

May 7, 1977 [DE] Fed. Rep. of Germany ..... 2720711

[51] Int. Cl.[3] ..... F16H 21/18; F01B 3/00; F04B 1/26

[52] U.S. Cl. ..... 74/42; 91/505; 91/506; 417/222

[58] Field of Search ..... 417/222; 74/42; 91/505, 91/506; 92/122, 71, 147

[56] References Cited

U.S. PATENT DOCUMENTS

| | | | |
|---|---|---|---|
| 3,106,057 | 10/1963 | Manning et al. | 417/222 |
| 3,643,549 | 2/1972 | Nagatomo | 91/505 |
| 3,682,047 | 8/1972 | Anderson | 91/505 |
| 3,941,514 | 3/1976 | Louis | 417/222 X |
| 3,967,541 | 7/1976 | Born et al. | 91/506 |
| 3,982,470 | 9/1976 | Adams et al. | 92/12.2 |
| 3,991,658 | 11/1976 | Bobier | 91/505 |
| 4,026,195 | 5/1977 | Forster | 92/12.2 |
| 4,037,521 | 7/1977 | McLeod | 92/71 X |
| 4,097,196 | 6/1978 | Habiger | 417/222 |
| 4,102,607 | 7/1978 | Benson | 417/222 |
| 4,121,503 | 10/1978 | James | 91/505 |
| 4,125,058 | 11/1978 | Forster | 417/222 X |
| 4,168,653 | 9/1979 | Hein | 91/506 |

FOREIGN PATENT DOCUMENTS

| | | | |
|---|---|---|---|
| 1232026 | 1/1967 | Fed. Rep. of Germany | 74/42 |
| 2141724 | 3/1973 | Fed. Rep. of Germany | 417/222 |
| 2240714 | 3/1973 | Fed. Rep. of Germany | 91/506 |
| 1776206 | 7/1975 | Fed. Rep. of Germany . | |
| 626259 | 10/1961 | Italy | 91/505 |

OTHER PUBLICATIONS

"Hydro-Verstellpumpe", 2 pages, Linde AG, Guldner Aschaffenburg Division.

*Primary Examiner*—Leslie Braun
*Attorney, Agent, or Firm*—Yount & Tarolli

[57] ABSTRACT

An axial piston machine having relatively swingable oblique disc and cylinder block components, a yoke lever spring urged against stationary stops on the housing when the components are in a zero stroke position and swinging around one of the stops when the swingable component is moved from its neutral position by a setting mechanism separate from the biasing spring for the yoke lever.

10 Claims, 4 Drawing Figures

SPRING RETURN MECHANISM FOR AXIAL PISTON MACHINES

BACKGROUND OF THE INVENTION

The invention relates to a spring return mechanism, particularly a spring return mechanism for an axial piston machine which is operable either as a pump or as a motor. Axial piston machines may be described as having two components one a cylinder block in which pistons operate and the other a plate or disc (oblique disc) against which the pistons bear. Operation of the machine is effected by rotating one of the components relative to the other or by effecting rotation of one or both the components by applying a fluid under pressure to the cylinders. In adjustable machines, one of the components is supported for relative swinging or rocking movement with respect to the other component from a neutral position where the disc or plate is perpendicular to the axis of the cylinders. The movement of the rockable component from neutral produces relative inclination of the plate and the cylinder block axis to adjust the delivery or power of the machine. In operation one or both of the components may be rotating and when the components are in their neutral position the plate and the cylinder block have the same axis which is also the axis of rotation. This may be termed the axis of the machine.

Commonly, the relatively swingable components of the axial piston machine are spring biased to their neutral, i.e. zero stroke position. It is important that the spring biasing act to return the components to the zero stroke position since if this is not done accurately, power may be inadvertently transmitted by the machine when the prime mover for effecting operation of the machine, for example, an internal combustion engine connected to rotate one of the components, is started. In known spring return devices for such machines, the spring engages a lever arm off the axis of swinging of the adjustable component. In many designs, there is a spring pocket on each side of the swinging axis and commonly the spring pockets are located within hydraulic cylinders of a servo mechanism for effecting the swinging. Such an arrangement is extremely costly and requires much construction, space, and weight, and above all, necessitates joints in which a play can occur. Also such arrangements are hard to get at from outside for the purpose of adjustment. In a known spring return mechanism for the swinging of a housing, there is a spring coaxial with the serving setting piston. This spring is stretched between stops so that with each displacement of the servo piston from the zero stroke position thereof and regardless of the direction of movement of the servo piston, the spring is compressed. (See publication of Linde AG, Guldner Aschaffenburg Division) Here also, a joint part is still needed between the spring and swinging part at which play can occur.

SUMMARY OF THE INVENTION

The present invention attacks the problem of providing a simple return spring mechanism which requires little space which biases the components to zero stroke position without the inter-position of joint parts which are particularly subject to play and is readily subject to adjustment from the outside of the axial piston engine. In accordance with the present invention, a yoke-like lever member (see West German Pat. No. 1,232,026) is spring biased to bear against one of the components and when the machine is in its neutral position to bear against stops on the other of the components and is constructed and supported in such a manner that the yoke-lever swings about one or the other of the stops with movement of the swingable component. The spring biasing may be accomplished by two tension springs which are connected to opposite ends of the yoke. Preferably, however, the spring biasing is a compression spring which is carried by one of the components so that it acts along a line of force which intersects the swinging axis of the swingable component. The structure of the invention makes it possible to design the spring return mechanism so that only a single return spring pocket is necessary so that only one return spring system is needed. In the preferred and illustrated embodiment, the stops for the yoke lever are disposed on opposite sides of a spring whose line of force intersects the swinging axis of the swingable component and the yoke lever has locations which bear against the swingable component on opposite sides of the force line of the spring.

It is particularly advantageous to make the stops against which the yoke is biased adjustable. While it is known per se to use adjustable stops in spring return mechanisms in axial piston engines, the structure of the present invention makes it possible to arrange these stops so that they are easily accessible and adjustable from outside the housing of the axial piston engine.

A further aspect of the invention is to provide a yoke lever apart from the setting lever or servo for rocking the swingable component so that when components are swung from their zero stroke position, the lever only bears against one of the stops.

Further in accordance with the present invention, the disc or plate component (oblique) of the axial piston engine has a convex semi-cylindrical surface which lies against a concave semi-cylindrical surface of the housing with the spring serving the purpose of centering and at the same time pressing the rocking body against the concave cylindrical surface so that the rocking component is biased from lifting off of this support surface. Normally in operation, the rocking body does not tend to lift off its support surface but it does do so in adjustable axial piston engines where the action of a centering spring is necessary when the pistons are not being urged against the disc plate by operating pressure.

A further aspect of the invention is the provision of an auxiliary piston which is operable to disengage the return spring from bearing against the yoke so that the spring does not tend to return the disc to its zero stroke position. Immediately upon the removal of pressure from the auxiliary cylinder, the return spring becomes effective and presses the rocking component into zero stroke position and also presses the rocking component against its bearing surface. The auxiliary piston may be operated from the pressure of the axial piston machine or in a machine with a servo power booster device operated under control pressure by the pressure for the servo device. It should be noted here that in this connection with spring return mechanism of this kind it is already known to connect the spring with an auxiliary piston which is under pressure and to lift off the spring from its particular stop (West German Pat. No. 1,776,206).

DESCRIPTION OF THE DRAWINGS

The advantages and objects of the present invention will be better understood by reference to the following specification and accompanying drawings illustrating a preferred embodiment of the present invention and in which.

Figure 1:
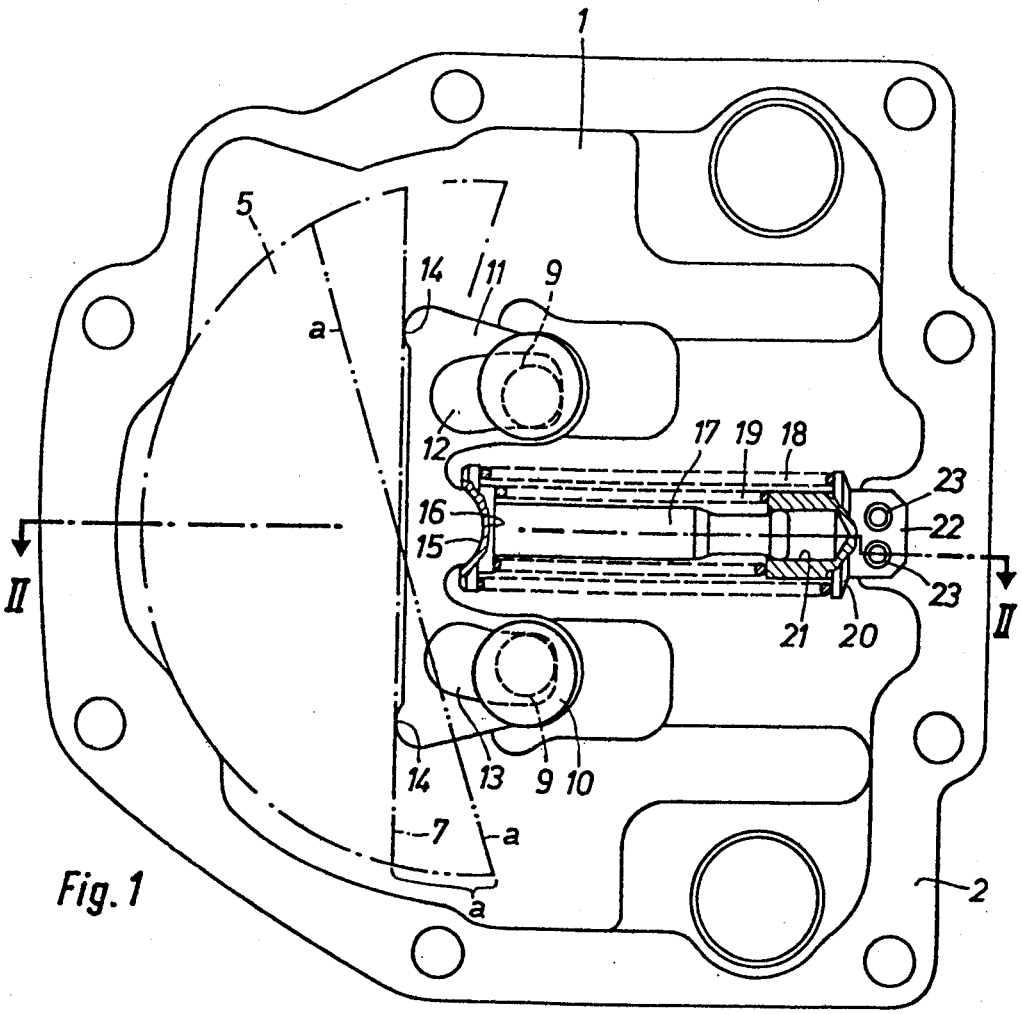
FIG. 1 shows a view looking in the housing cover of an oblique disc axial piston engine.
Figure 2:
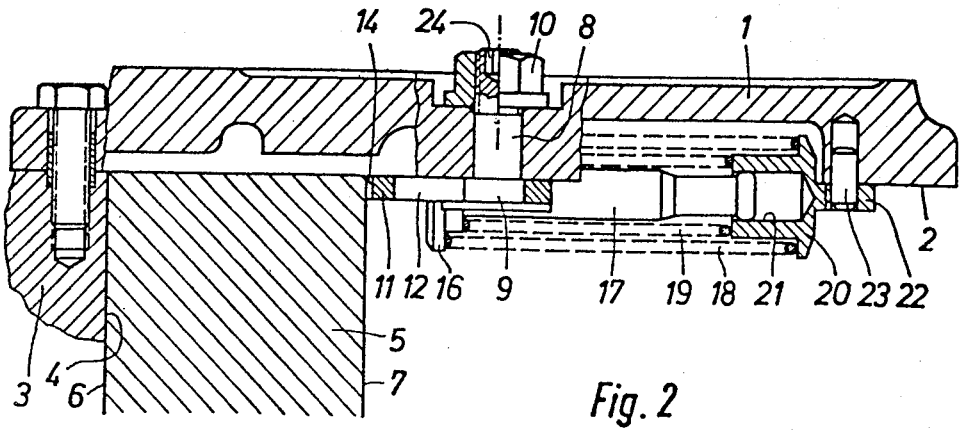
FIG. 2 shows a section to the cover along line II—II of FIG. 1.

Referring to the drawings, the housing cover 1 of an axial piston engine is provided with a flange surface 2 by which the cover is mounted on the housing 3 of the axial piston machine (see FIG. 2). The housing 3 has a concave cylindrical surface 4 against which the rocking component of body 5 bears. The rocking body 5 has a cylindrical surface on the side opposite the oblique disc surface 7 of the machine. In other words the rocking body 5 to the extent illustrated is a part of the disc or plate of the axial piston machine. The body 5 may be rocked about the axis of the cylindrical bearing surface in either direction to extreme positions indicated in the diagram. When rocked in a counterclockwise direction as viewed in FIG. 1 the extreme position has been indicated with a dashed line with two dots and the extreme position in the other direction has been indicated with a dashed line with a single dot.

A spring return mechanism is provided for returning the rocking body 5 to a neutral or zero stroke position which body is shown in full by dot dashed lines in FIG. 1 in its neutral position. The rocking body may also be rocked to extreme positions one shown in dot dot/dash lines and designated with the reference character "a" and to the opposite extreme being shown by a fragmentary dot/dash line. The mechanism includes a lever 11 of yoke-like form and which has projections or knobs 14 which bear against the oblique surface 7 of the rocking body 5. Knobs 14 bear against the surface 7 on opposite sides of the rocking axis of body 5. In addition, the yoke lever 11 has slots 12 and 13 on the opposite sides of the axis which receive stops 9 mounted on the cover 1 with the ends of the slots 12 and 13 bearing against the stops 9 when the body member 5 is in its neutral position. The stops 9 are each eccentric portions of a pin 8 which is received in a bore in the cover, extends through the cover and has a threaded end for a nut 10 which locks the pin in position on the cover.

The mating portion yoke lever 11 also has an arc-shaped projection 15, which engages a spring pressure plate 16 formed as a part of a spring guide pin 17. The spring guide pin 17 is surrounded by concentric springs 19 and 18 which engage the pressure plate 16 at one end and a second spring support member 20 at their other ends. The spring support member 20, as will be clear from the drawing has a flange portion against which the spring 18 rests and an internal portion against which the spring 19 rests and in which a bore 21 is formed for receiving one end of the guide pin 17. The spring support member 20 is provided with a flange 22 which is connected by fastening means to the housing cover 1 so that it is removable. The fastening means has been shown as two notched pins 23.

The described spring return mechanism requires little space and it can be placed in an ordinary housing cover 1 so that the construction volume of the axial piston machine is not increased. In particular the axial piston engine is preferably a pump which by operation of the spring return package is brought back to the zero stroke or neutral position. The axial piston engine may also be a hydromotor and if so the stops 9 are set correspondingly and symmetrical so that they define the least deflected position of the rocking bottom of the body if the problem is such that the motor must be returned in each case into the least deflection position with which a given stream of fluid corresponds to the maximum RPM. The spring return mechanism according to the invention at least in the preferred embodiment shown in the drawings is independent of and separated in space from surfaces under control pressure or any other servo power setting device or operating lever which may be present.

In operation, the rocking body 5 is pressed by the springs toward the concave cylindrical bearing surface of the housing so that even, for example, in transporting the axial piston machine dismanteled from other mechanism, the rocking body can not knock in the housing or be displaced but is always secure in its position.

The eccentrics 9 can easily be adjusted from outside by rotating the pins 8 upon loosening of the nut 10. To effect rotation of an eccentric, the outer end of the pin 8 is provided with a recess for receiving a setting tool such as an allen wrench. Such adjustment makes it possible to exactly adjust the zero stroke position to which the rocking body is returned and to effect a contact free of play. There is no difficulty in installing springs 18 and 19 of relatively large spring force and the yoke lever part 11 is a simple part to manufacture as it may be pressed or stamped.

The operation of the machine is as follows.

Figure 3:
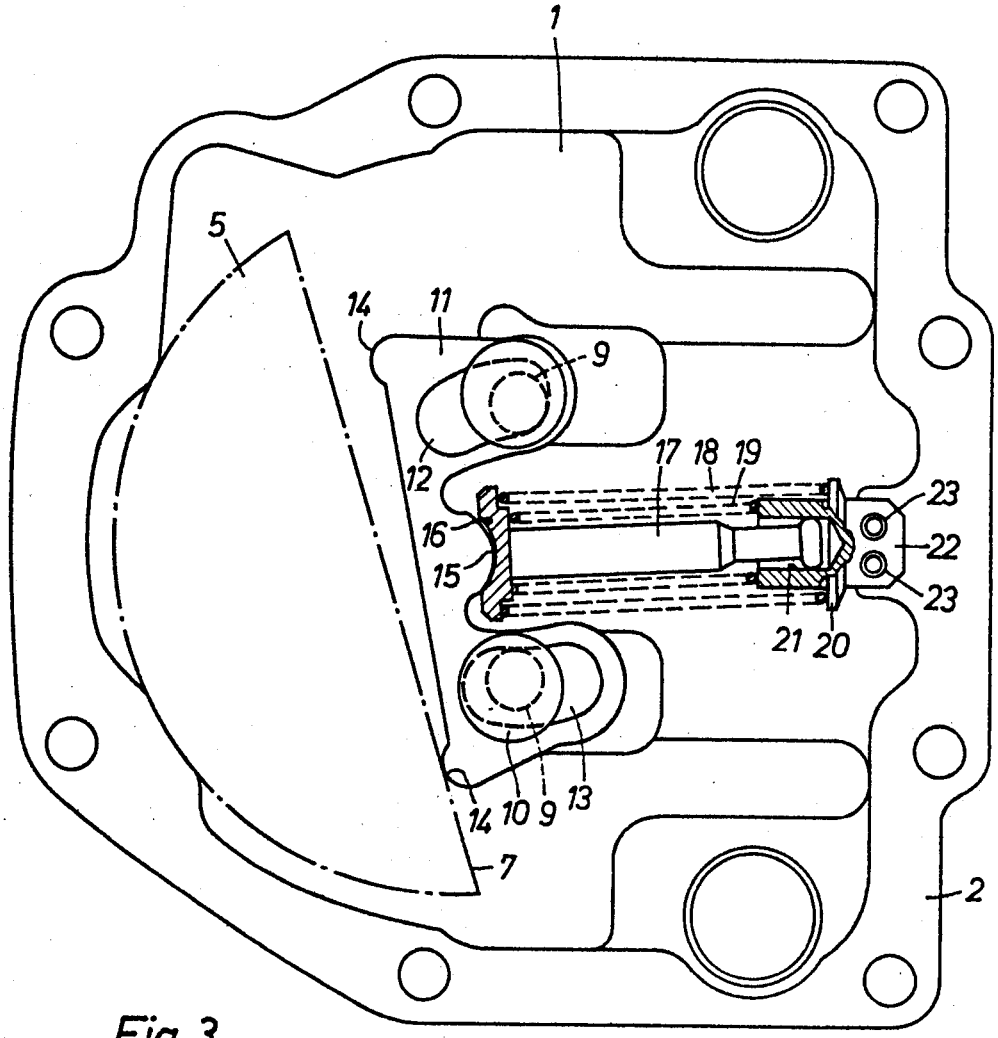
FIG. 3 shows a view similar to FIG. 1 but illustrating the parts in different positions.

In the neutral position of the rocking body 5, that is, the position in which the oblique disc surface 7 is perpendicular to the axis of rotation of the cylinder block (not shown in the drawing but located underneath the spring pocket 17 as viewed in FIG. 2 so that the piston rods may work against the oblique surface 7). The two projections or knobs 14 of the yoke lever lie against the surface 7 and each of the two eccentrics 9 bear against the end of the respective one of its slots 12 or 13. The springs 18 and 19 press the yoke lever part 11 against the surface 7 of the rocking body 5 and also against the eccentrics 9. Thus by the position of eccentrics 9, the position of the surface 7 is clearly defined. If through the operation of a conventional control device such as a servo mechanism or setting lever, the rocking body 5 is swung out of its position by movement in a counterclockwise direction, as illustrated by position a in FIG. 1, the oblique disc surface 7 pushes against the projection knob 14, the lower one as viewed in FIG. 1, to swing the yoke lever 11 about the eccentric stop 9, the upper eccentric stop 9, as viewed in FIG. 1. In this movement, the lower eccentric 9 loses contact with the end of the slot 13 and the slot accommodates the swinging motion of the yoke lever 11. This swinging movement produces forces acting on the yoke lever 11, namely the forces from springs 18 and 19 which act against the projection 15 and reaction forces in the upper eccentric 9 as viewed in FIG. 1 which operates in slot 12. Under the action of these forces, the lower projection 14, exerts on the oblique disc surface 7 a return force operating in a direction to return the rocking body to a zero stroke or neutral position when the setting force for the rocking body is released. This position is represented in the FIG. 3. A similar effect occurs when the rocking body 5 is swung in the opposite direction from the neutral position corresponding to zero stroke.

The guide pin 17 shown in the drawing with the spring plate 16 is not absolutely necessary, rather, a spring, or equivalent springs 18, 19 may also lie directly against the middle part of the yoke lever part 11. In arranging such springs, their bending stress must be taken into account where they bear directly against the yoke lever 11 rather than through a spring pressure plate of the type shown.

The present construction also makes it simple to provide a mechanism or means for releasing the pressure applied by the springs 18 and 19 when the rocking body 5 is displaced from its neutral or zero position. An auxiliary piston cylinder arrangement may be provided with a mechanical connection to the spring pressure plate 16 to compress the springs and release the pressure of the pressure plate against the projection 15 on the yoke lever when the yoke lever is swung for its neutral position. Alternatively, the opening 21 for receiving the guide pin 17 may be formed into a single acting cylinder whereby extending and closing the receiving portion of the member 20 for the guide pin 17 and supplying pressure inside this "cylinder" the spring guide pin can be moved backwardly to relieve pressure.

Figure 4:
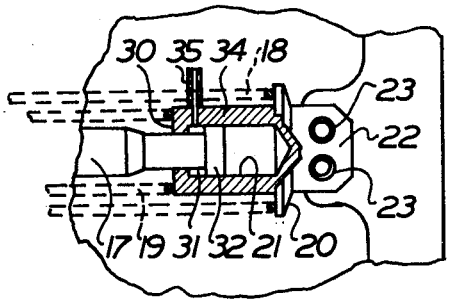
FIG. 4 is a fragmentary view of another embodiment of the present invention.

One particular embodiment of said auxiliary piston cylinder arrangement is represented in FIG. 4. The part 34 in which the bore 21 is formed is extended to the left in the drawing as compared with the design of FIG. 1, and has a sealing plate 30, which grips around the tapered part of the pin 17. The end part 32 of the pin 17 can move within the bore 21. Between the sealing plate 30 and the end part 32 of pin 17 a cylindrical pressure chamber 31 is formed into which pressure medium can be introduced through a line 35. Relieving spring pressure may be beneficial in that the biasing pressure is not needed when the machine is operating since the pistons of the machine will bias the oblique disc 5 against its bearing surface but the spring bias is primarily advantageous when the rocking body has a neutral position to be returned to and maintained in that position.

What is claimed is:

1. A variable delivery axial piston machine having a housing, a part angularly adjustable about an axis to vary the delivery of the machine and having a zero stroke position, mechanism for restoring said part to a zero stroke position, stops arranged on opposite sides of said axis and cooperating with said mechanism to define said zero stroke position, said mechanism comprising a movable yoke lever in contact with and movable relative to said angularly adjustable part, said yoke lever contacting said angularly adjustable part on opposite sides of said axis when said angularly adjustable part is in said zero stroke position and engaging said stops in said zero stroke position and being movable relative to said stops and said angularly adjustable part and lifted off one of said stops on movement of said angularly adjustable part from said zero stroke position, and spring means acting on said movable yoke lever to bias said movable yoke lever against said angularly adjustable part and at least one of said stops.

2. A variable delivery axial piston engine as defined in claim 1 wherein said stops are fixed to the housing and are adjustable from outside of the housing.

3. A variable delivery axial piston machine as defined in claim 1 wherein said mechanism includes a pivot connection between said spring and said yoke lever and located in the vicinity of said axis.

4. A variable delivery axial piston machine as defined in claim 1 wherein said housing includes a cover and the restoring device and said stops are mounted on the cover.

5. An machine as defined in claim 1 wherein the spring rests frictionally against the yoke lever and an auxiliary piston is connected to said spring for lifting the spring away from the yoke lever component.

6. A variable delivery axial piston machine as defined in claim 1, further including means for adjusting said stops and wherein said movable yoke lever is shiftable radially upon adjustment of either of said stops.

7. A variable delivery axial piston machine as defined in claim 1 wherein said spring means comprises a compression spring which lies along a line intersecting said axis about which the angularly adjustable part is angularly adjustable.

8. A variable delivery axial piston machine having a housing, a part angularly adjustable about an axis to vary the delivery of the machine and having a zero stroke position, mechanism for restoring said part to said zero stroke position, stops arranged on opposite sides of said axis and cooperating with said mechanism to define said zero stroke position, said mechanism comprising a movable yoke lever in contact with and movable relative to said angularly adjustable part, said yoke lever contacting said angularly adjustable part on opposite sides of said axis when said angularly adjustable part is in said zero stroke position and engaging said stops in said zero stroke position and being movable relative to said stops and said movable part and lifted off one of said stops on movement on said angularly adjustable part from said zero stroke position, a spring acting on said yoke lever to bias said yoke lever against said angularly adjustable part and said stops, said spring being a compression spring which lies along a line intersecting said axis, and a pivot connection between said spring and said yoke lever and located in the vicinity of said axis.

9. A variable delivery axial piston machine having a housing, a part angularly adjustable to vary the delivery of the machine and having a zero stroke position, mechanism for restoring the part to its zero stroke position, stationary stops which cooperate with said mechanism to define the zero stroke position, said mechanism comprising a movable yoke lever in contact with said adjustable part and engaging said stops in zero stroke position and moved relative to said stops on movement from a zero stroke position, a spring acting on said lever to bias said lever against said part and said stops, said angularly adjustable part being angularly adjustable about an axis, said spring being a compression spring which lies along a line intersecting said axis, said stops being fixed to the housing and adjustable, said yoke lever being swingable about one or the other of said stops on movement of said part from its zero stroke position, a pivot connection between said spring and said yoke lever and located in the vicinity of said axis, said yoke lever being provided with two circular-arc slots, and said stops are eccentric pins acting as stops and disposed at corresponding one ends of the respective slots when the angularly adjustable part is in the zero stroke position thereof, the center of curvature of each slot being situated in said one end of the other slot.

10. A variable delivery axial piston machine as defined in claim 9 wherein said yoke lever contacts said part on opposite sides of said axis.

* * * * *